US009016247B2

(12) United States Patent
Gu

(10) Patent No.: US 9,016,247 B2
(45) Date of Patent: Apr. 28, 2015

(54) FOUR-CYLINDER FOUR-STROKE ENGINE WITHOUT A CRANKSHAFT AND VALVES

(71) Applicant: Ruei-Ting Gu, Kaohsiung (TW)

(72) Inventor: Ruei-Ting Gu, Kaohsiung (TW)

(73) Assignees: Ruei-Ting Gu, Kaohsiung (TW); Kuo-Chen Weng, Tainan (TW)

( * ) Notice: Subject to any disclaimer, the term of this patent is extended or adjusted under 35 U.S.C. 154(b) by 37 days.

(21) Appl. No.: 14/037,436

(22) Filed: Sep. 26, 2013

(65) Prior Publication Data

US 2015/0083059 A1 Mar. 26, 2015

(51) Int. Cl.
*F01B 3/00* (2006.01)
*F02F 7/00* (2006.01)

(52) U.S. Cl.
CPC ..... *F02F 7/0019* (2013.01)

(58) Field of Classification Search
USPC ..... 123/56.1–56.9
See application file for complete search history.

(56) References Cited

U.S. PATENT DOCUMENTS 3,895,614 A 7/1975 Bailey
5,452,689 A 9/1995 Karlan
5,562,075 A 10/1996 Walsh
5,743,220 A * 4/1998 Guarner-Lans ..... 123/56.9
5,992,357 A * 11/1999 Tasi ..... 123/56.2
6,729,290 B1 * 5/2004 Rorke ..... 123/193.6
7,451,687 B2 11/2008 Lynn et al.
8,448,614 B1 * 5/2013 Gu ..... 123/56.1
2006/0288971 A1 * 12/2006 Tasi et al. ..... 123/56.1

FOREIGN PATENT DOCUMENTS

DE 3419582 A1 11/1985

* cited by examiner

*Primary Examiner* — Marguerite McMahon
(74) *Attorney, Agent, or Firm* — Alan D. Kamrath; Kamrath IP Lawfirm, P.A.

(57) ABSTRACT

A four-cylinder four-stroke engine contains a base, a gas valve, a holder, a driving device, and a driven assembly, and a seat. When a four-cylinder four-stroke engine operates, a plurality of cylinders push plural pistons in the plurality of cylinders of the driving device so as to drive plural pushing posts connecting with the plural pistons to move upward and downward repeatedly, such that the driven assembly coupling with the plural pushing posts is pushed to drive a rotary shaft to rotate, thus generating a rotational energy, and the driven assembly simultaneously pushes a gear set of the driving device so that the gear set drives the gas valve on the base to rotate 360 degrees to feed and exhaust gases in the base, such that the plurality of cylinders are driven to feed, compress, burst, and exhaust gases continuously without using a crankshaft and valves.

1 Claim, 23 Drawing Sheets

FOUR-CYLINDER FOUR-STROKE ENGINE WITHOUT A CRANKSHAFT AND VALVES

BACKGROUND OF THE INVENTION

1. Field of the Invention

The present invention relates to a four-cylinder four-stroke engine in which a gas valve rotates 360 degrees in a base and has gas feeding and gas exhausting operation, and a driven assembly matches with a rotary shaft, the gear set is applied to decrease a rotating speed ratio so as to cycle gas feeding, compression, burst, and gas exhausting.

2. Description of the Prior Art

A cycling operation of a conventional engine has two or four strokes, and a power is supplied to the engine by a crankshaft, i.e., the crankshaft is an output shaft of the engine. However, a top end and a bottom end of the crankshaft can not communicate with each other, so the crankshaft is formed in a curve shape based on a number of the at least one piston so that a vertical movement of a piston is transferred into a rotational movement. But as the at least one piston moves linearly upward and downward, a curved portion of the crankshaft is eccentric, so that the at least one piston moves eccentrically upward and downward, and then the at least one piston produces a lateral force to rub at least one cylinder, thus wearing and breaking the at least one piston and the at least one cylinder.

In addition, the conventional engine is provided with plural gas valve sets so as to operate gas feeding, compression, burst, and gas exhausting, accordingly the engine has a complicated structure.

The present invention has arisen to mitigate and/or obviate the afore-described disadvantages.

SUMMARY OF THE INVENTION

The primary object of the present invention is to provide a four-cylinder four-stroke engine without a crankshaft and valves in which a driven assembly is fixed and four cylinders operate repeatedly so output power, such that a first tube is mounted and moves horizontally in a trench of a second tube, thus preventing four pushing posts of four pistons from interference in operation.

Secondary object of the present invention is to provide a four-cylinder four-stroke engine without a crankshaft and valves which allows providing a gear set so as to control a rotating speed ratio between a rotary shaft or the driven assembly and a gas valve, such that the gas valve operates continuously to feed gas into four cylinders and to exhaust gas out of the four cylinders, thus cycling gas feeding, compression, burst, and gas exhausting.

Further object of the present invention is to provide a four-cylinder four-stroke engine without a crankshaft and valves in which a gas valve rotates 360 degrees in a base and has gas feeding and gas exhausting operation among the four cylinders, and the gear set is used to control a rotating speed ratio of the driven assembly and the gas valve, and the rotating speed ratio is 4:1.

Another object of the present invention is to provide a four-cylinder four-stroke engine without a crankshaft and valves which after a vertical length of a fixed pole and a holder is selected, four limit heights of the four pistons in the four cylinders are determined based on the rotary shaft, the driven assembly, and the four pushing posts, such that the first cylinder and the second cylinder have various compression ratios, hence the four-stroke engine is applicable for diesel fuel or gasoline fuel.

A four-cylinder four-stroke engine without a crankshaft and valves contains:

a base, a gas valve, a holder, a driving device, and a driven assembly, and a seat. When a four-cylinder four-stroke engine operates, a plurality of cylinders push plural pistons in the plurality of cylinders of the driving device so as to drive plural pushing posts connecting with the plural pistons to move upward and downward repeatedly, such that the driven assembly coupling with the plural pushing posts is pushed to drive a rotary shaft to rotate, thus generating a rotational energy, and the driven assembly simultaneously pushes a gear set of the driving device so that the gear set drives the gas valve on the base to rotate 360 degrees to feed and exhaust gases in the base.

The base includes a gas groove defined thereon, a first cylinder, a second cylinder, a third cylinder, and a fourth cylinder, wherein any two adjacent of the first, the second, the third, and the fourth cylinders are symmetrically arranged around the gas groove, and the first cylinder has a first flowing hole for communicating with the gas groove, the second cylinder has a second flowing hole for communicating with the gas groove, the third cylinder has a third flowing hole for communicating with the gas groove, the fourth cylinder has a fourth flowing hole for communicating with the gas groove; the gas groove has a first inlet formed on a side wall thereof and communicating with an exterior of the base, and a first outlet defined on a bottom surface thereof and communicating with the exterior of the base; wherein a bottom plate of the holder is screwed on a top surface of the base by ways of plural screw elements, such that the gas groove, the first cylinder, the second cylinder, the third cylinder, the fourth cylinder of the base are covered by the bottom platen, and the gas groove includes a washer fixed on a top rim thereof so that the holder closes the gas groove.

The gas valve is disposed in the gas groove and includes two second inlets which communicate with each other and two third inlets which are in communication with each other, wherein one of the two second inlets is defined on a top surface of the gas valve, and the other of the two second inlets is formed on an external wall of the gas valve, one of the two third inlets is defined on the top surface of the gas valve, and the other of the two third inlets is formed on the external wall of the gas valve; the gas valve also includes two second outlets which communicate with each other and two third inlets which are in communication with each other, wherein one of the two second outlets is defined on a bottom surface of the gas valve, and the other of the two second outlets is formed on the external wall of the gas valve, one of the two third outlets is defined on the bottom surface of the gas valve, and the other of the two third outlets is formed on the external wall of the gas valve; wherein an angle among the two second inlets and the two third outlets is 135 degrees, and among the two third inlets and the two second outlets is 135 degrees, and when the gas valve operates, the two second inlets, the two third inlets, the two second outlets, and the two third outlets are in communication with the first flowing hole, the second flowing hole, the third flowing hole, and the fourth flowing hole; and the gas valve further includes four first bearings, mounted on the top surface of the gas valve, extending out of the bottom plate, and driving a connecting rod of the gas valve.

The driving device includes four pushing posts for connecting with a first piston, a second piston, a third piston, and a fourth piston, the driven assembly connects with four top ends of the four pushing rods, and the driving device also includes the rotary shaft connecting with a first guide peg of the driven assembly, the gear set coupled with a second guide peg of the driving device, four ends of the four pushing posts join with a first support, a second support, a third support, and a fourth support via four pivots; the driven assembly includes a first tube, a second tube, the first support, the second support, the third support, and the fourth support, wherein the first tube is mounted and moves horizontally in a trench of the second tube, the first tube has a first eyelet and a second eyelet defined on two ends thereof, and the first eyelet has a first aperture formed on a bottom end thereof, the second eyelet has a second aperture arranged on a bottom end thereof and communicating with the first eyelet, the first eyelet is used to insert the first support for coupling with one of the four pushing posts, and the second eyelet is served to insert the second support for connecting with one of the four pushing posts, wherein the first support extends and retracts in the first eyelet, and the second support extends and retracts in the second eyelet, such that gas exhausts out of the first aperture and the second aperture; the second tube has a third eyelet and a fourth eyelet defined on two ends thereof and communicating with the trench, the third eyelet is used to insert the third support for coupling with one of the four pushing posts, and the fourth eyelet is applied to insert the fourth support for connecting with one of the four pushing posts, wherein the third support extends and retracts in the third eyelet, and the fourth support extends and retracts in the fourth eyelet, such that the gas exhausts out of the trench, and the second tube has the first guide peg and the second guide peg; wherein the rotary shaft includes a vertical extension and a horizontal extension being perpendicular to the vertical extension and in connection with the vertical extension, the vertical extension is fixed by a second bearing and extends out of the seat, the horizontal extension has a first tilted bar obliquely extending from one end thereof, and the first tilted bar has a first opening defined thereon, the first opening has a first rotatable bearing secured therein, the first rotatable bearing is in connection with the first guide peg of the second tube so that a rotary free degree is formed between the first guide peg and the first rotatable bearing; the gear set includes three panels connecting with the bottom plate of the holder so as to form a room, an upper gear and a bottom gear inserted into and being coaxial with a top portion of the panel, a drive gear and a driven gear coupling with the bottom portion of the panel by using a rotary stem and meshing with the upper gear and the lower gear, wherein the drive gear has a second tilted bar mounted thereon for corresponding to the first tilted bar, the second tilted bar has a second opening arranged thereon, a second rotatable bearing received in the second opening, such that a distal end of the second guide peg inserts in the second rotatable bearing so that a rotary free degree is formed between the second guide peg and the second rotatable bearing, and the rotary stem of the driven gear is in connection with a top end of the connecting rod of the gas valve so that when the drive gear rotates four circles, the driven gear is driven by the upper gear and the lower gear to rotate one circle, so the gear set is used to control a rotating speed ratio of the rotary shaft or the driven assembly and the gas valve, and the rotating speed ratio is 4:1.

The seat has a peripheral side coupling with a top rim of the holder, a fixed pole axially connecting with the holder and the base and screwed by a nut; wherein the vertical extension of the rotary shaft extends out of the seat, and the vertical extension and the seat are fixed together by the second bearing so that the vertical extension has an axially rotary free degree.

BRIEF DESCRIPTION OF THE DRAWINGS

FIG. 5A1 is a partial enlarged diagram showing the operation of the first cylinder and the second cylinder of the four-cylinder four-stroke engine of FIG. 5A according to the first embodiment of the present invention.

FIG. 5A2 is another partial enlarged diagram showing the operation of the first cylinder and the second cylinder of the four-cylinder four-stroke engine of FIG. 5A according to the first embodiment of the present invention.

FIG. 5C1 is a partial enlarged diagram showing the part of FIG. 5C according to the first embodiment of the present invention.

FIG. 5C2 is another partial enlarged diagram showing the part of FIG. 5C according to the first embodiment of the present invention.

DETAILED DESCRIPTION OF THE PREFERRED EMBODIMENTS

Figure 1A:
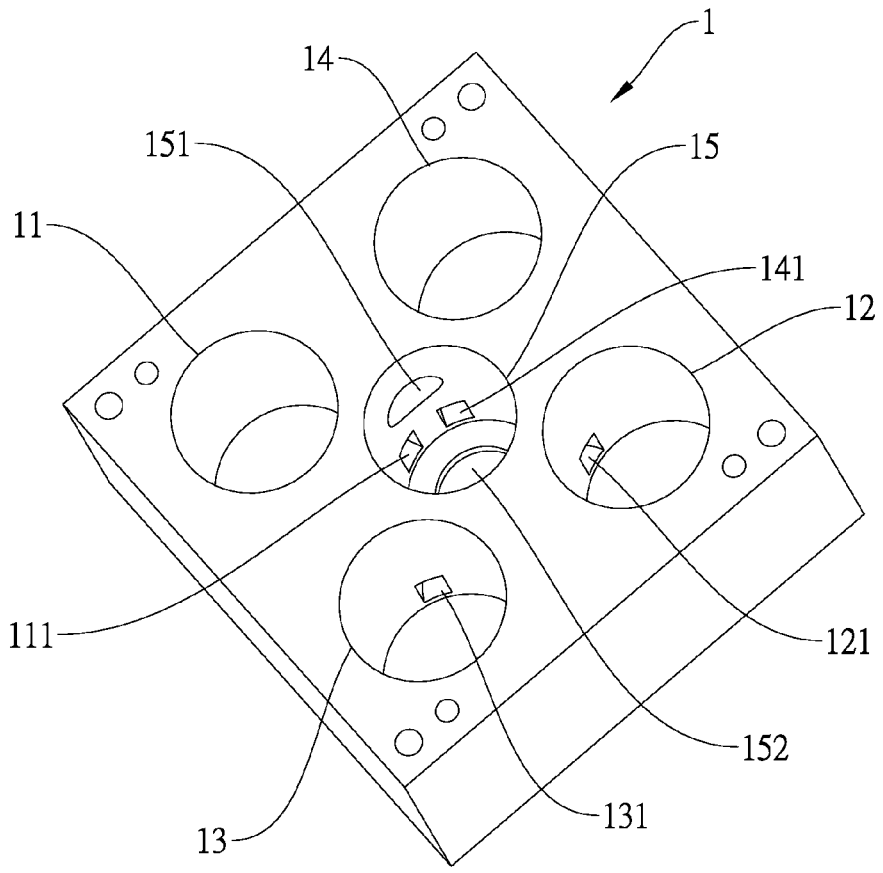
FIG. 1A is a perspective view showing the assembly of a base of a four-cylinder four-stroke engine according to a first embodiment of the present invention.
Figure 1B:
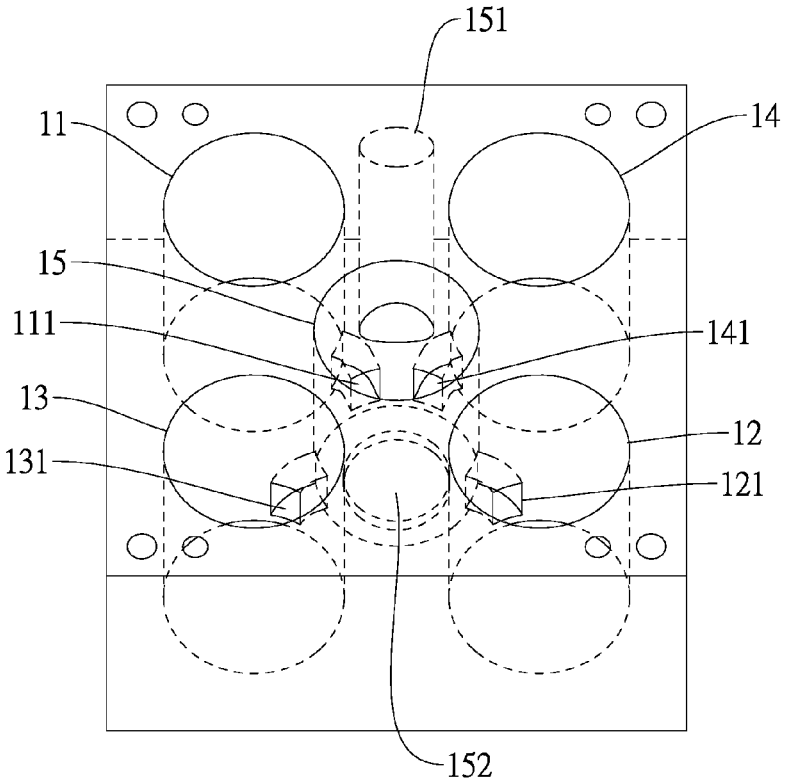
FIG. 1B is another perspective view showing the assembly of the base of the four-cylinder four-stroke engine according to the first embodiment of the present invention.
Figure 1C:
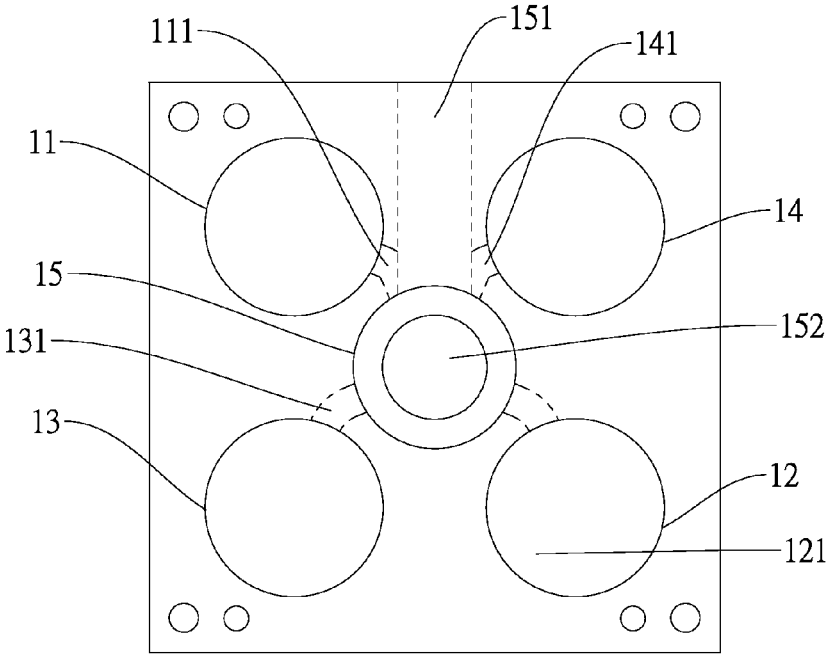
FIG. 1C is a plan view showing the assembly of the base of the four-cylinder four-stroke engine according to the first embodiment of the present invention.

The present invention will be clearer from the following description when viewed together with the accompanying feedings, which show, for purpose of illustrations only, the preferred embodiment in accordance with the present invention.

With reference to FIGS. 1A-1C, 2, 2A and 3, a four-cylinder four-stroke engine without a crankshaft and valves according to a first embodiment of the present invention is applicable for diesel fuel and comprises a base 1, a gas valve 2, a holder 16, a driving device 3, and a driven assembly 4, and a seat 8.

The base 1 (as shown in FIGS. 1A-1C and 2) includes a gas groove 15 defined thereon, a first cylinder 11, a second cylinder 12, a third cylinder 13, and a fourth cylinder 14, wherein any two adjacent of the first, the second, the third, and the fourth cylinders 11, 12, 13, 14 are symmetrically arranged around the gas groove 15, and the first cylinder 11 has a first flowing hole 111 for communicating with the gas groove 15, the second cylinder 12 has a second flowing hole 121 for communicating with the gas groove 15, the third cylinder 13 has a third flowing hole 131 for communicating with the gas groove 15, the fourth cylinder 14 has a fourth flowing hole 141 for communicating with the gas groove 15; the gas groove 15 has a first inlet 151 formed on a side wall thereof and communicating with an exterior of the base 1, and a first outlet 152 defined on a bottom surface thereof and communicating with the exterior of the base 1; wherein a bottom plate 161 of the holder 16 is screwed on a top surface of the base 1 by ways of plural screw elements 10, such that the gas groove 15, the first cylinder 11, the second cylinder 12, the third cylinder 13, the fourth cylinder 14 of the base 1 are covered by the bottom plate 161. In addition, the gas groove 15 includes a washer 18 fixed on a top rim thereof so that the holder 16 closes the gas groove 15.

Figure 2:
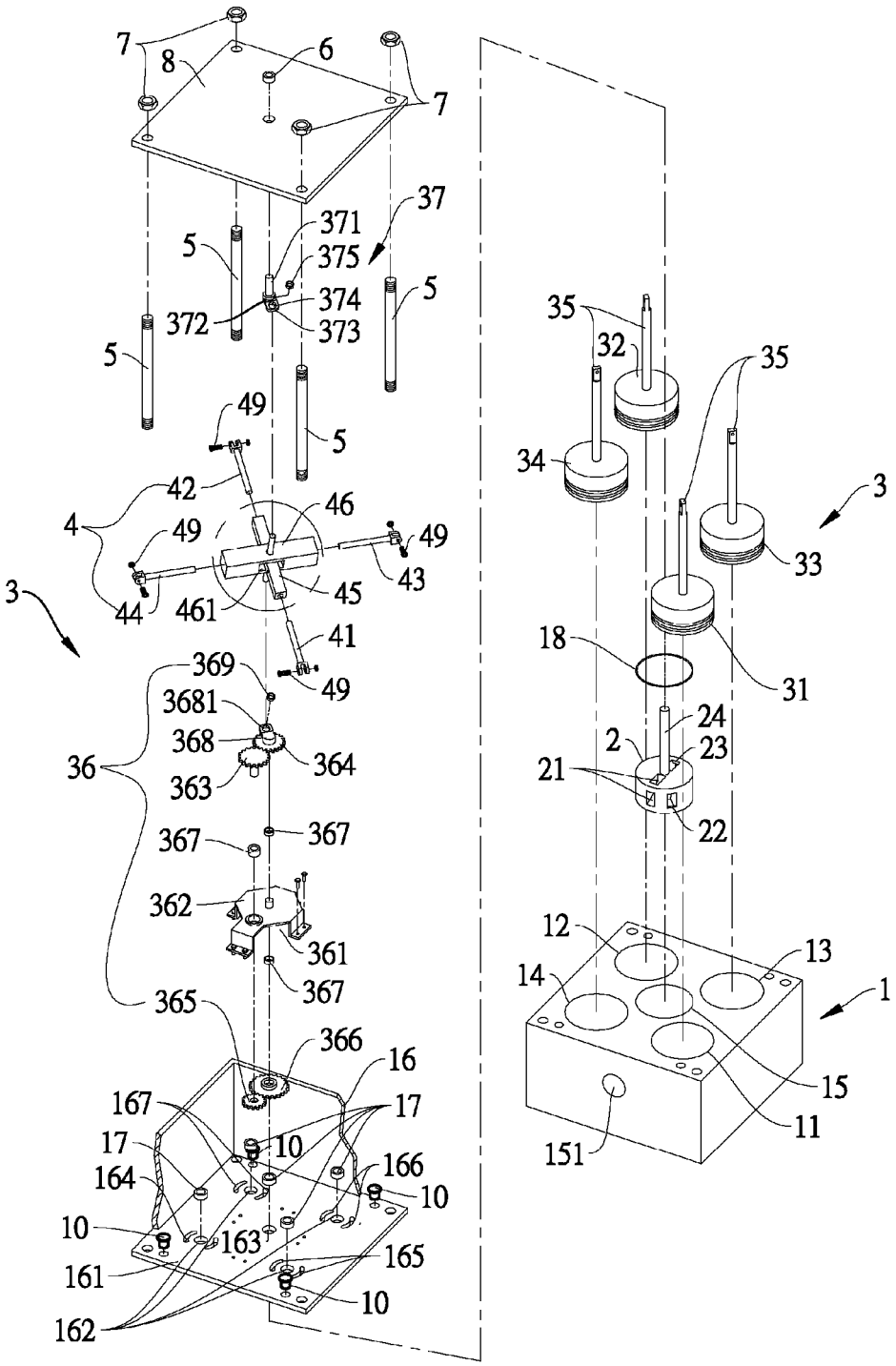
FIG. 2 is a perspective view showing the exploded components of the four-cylinder four-stroke engine according to the first embodiment of the present invention.

The gas valve 2 (as illustrated in FIG. 2) is disposed in the gas groove 15 and includes two second inlets 21 which communicate with each other and two third inlets 23 which are in communication with each other, wherein one of the two second inlets 21 is defined on a top surface of the gas valve 2, and the other of the two second inlets 21 is formed on an external wall of the gas valve 2, one of the two third inlets 23 is defined on the top surface of the gas valve 2, and the other of the two third inlets 23 is formed on the external wall of the gas valve 2; the gas valve 2 also includes two second outlets 22 which communicate with each other and two third outlets 25 which are in communication with each other, wherein one of the two second outlets 22 is defined on a bottom surface of the gas valve 2, and the other of the two second outlets 22 is formed on the external wall of the gas valve 2, one of the two third outlets 25 is defined on the bottom surface of the gas valve 2, and the other of the two third outlets 25 is formed on the external wall of the gas valve 2; wherein an angle among the two second inlets 21 and the two third outlets 25 is 135 degrees, and among the two third inlets 23 and the two second outlets 22 is 135 degrees, and when the gas valve 2 operates, the two second inlets 21, the two third inlets 23, the two second outlets 22, and the two third outlets 25 are in communication with the first flowing hole 111, the second flowing hole 121, the third flowing hole 131, and the fourth flowing hole 141; and the gas valve 2 further includes four first bearings 17 (such as a thrust bearing), mounted on the top surface of the gas valve 2, extending out of the bottom plate 161, and driving a connecting rod 24 of the gas valve 2.

The holder 16 (as shown in FIG. 2) is connected with the top surface of the base 1 and is formed in a hollow square shape, the bottom plate 161 of the holder 16 has two first orifices 164 for communicating with the first cylinder 11, two second orifices 165 for communicating with the second cylinder 12, two third orifices 166 for communicating with the third cylinder 13, and two fourth orifices 167 for communicating with the fourth cylinder 14, four fifth orifices 162, and plural bores, wherein the holder 16 is formed in the hollow square shape so as to receive a gear set 36 and the driving device 3.

Figure 2A:
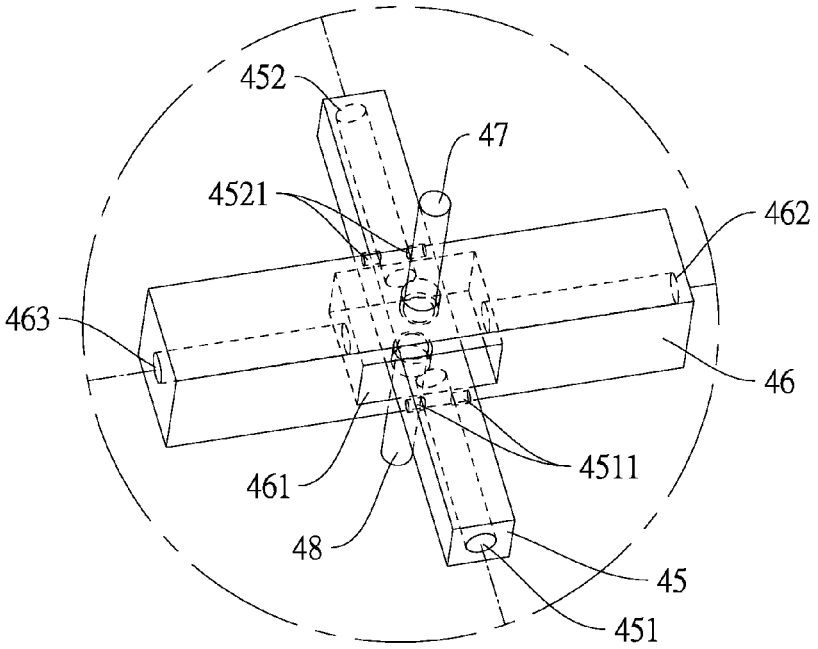
FIG. 2A is a partial enlarged diagram showing the assembly of the four-cylinder four-stroke engine according to the first embodiment of the present invention.
Figure 3:
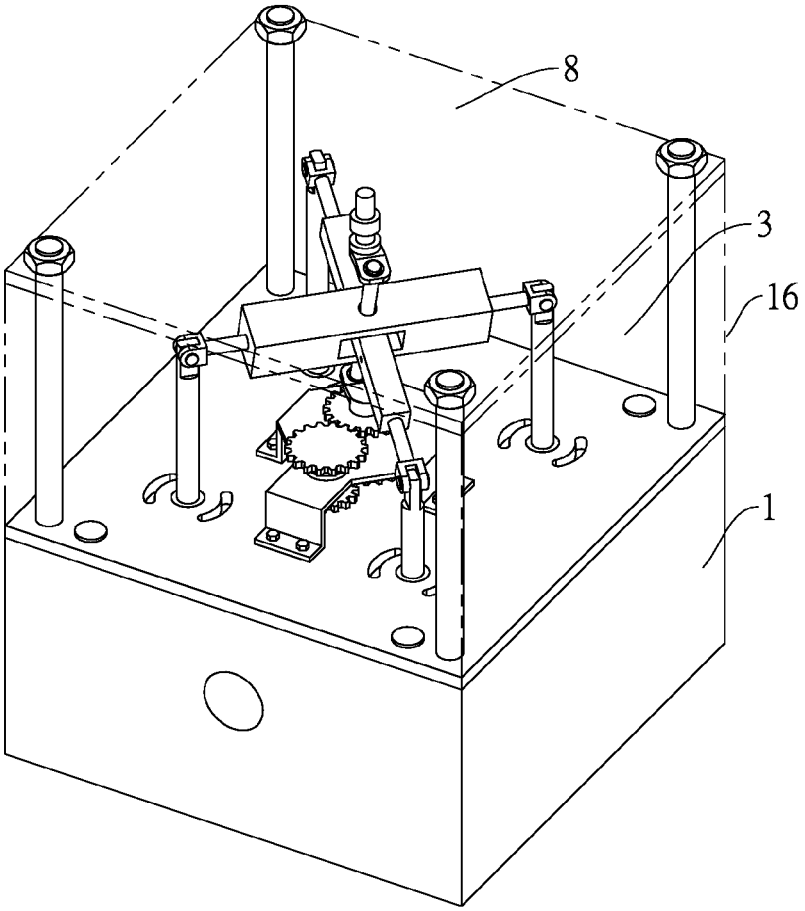
FIG. 3 is a perspective view showing the assembly of the four-cylinder four-stroke engine according to the first embodiment of the present invention.

The driving device 3 (as shown in FIGS. 2 and 2A) includes four pushing posts 35 for connecting with a first piston 31, a second piston 32, a third piston 33, and a fourth piston 34 (four top ends of the four pushing posts 35 insert into the first cylinder 11, the second cylinder 12, the third cylinder 13, and the fourth cylinder 14 via the four fifth orifices 162 of the bottom plate 161 and move upwardly and downwardly through the four first bearings 17 of the four fifth orifices 12, four bottom ends of the four pushing posts 35 include the first piston 31, the second piston 32, the third piston 33, the fourth piston 34 disposed thereon and include four diameters corresponding to those of the first cylinder 11, the second cylinder 12, the third cylinder 13, and the fourth cylinder 14), the driven assembly 4 connects with the four top ends of the four pushing rods 35, and the driving device 3 also includes a rotary shaft 37 connecting with a first guide peg 47 of the driven assembly 4, a gear set 36 coupled with a second guide peg 48 of the driving device 4, four ends of the four pushing posts 35 join with a first support 41, a second support 42, a third support 43, and a fourth support 44 via four pivots 49; the driven assembly 4 includes a first tube 45, a second tube 46, the first support 41, the second support 42, the third support 43, and the fourth support 44, wherein the first tube 45 is mounted and moves horizontally in a trench 461 of the second tube 46, the first tube 45 has a first eyelet 451 and a second eyelet 452 defined on two ends thereof, and the first eyelet 451 has a first aperture 4511 formed on a bottom end thereof, the second eyelet 452 has a second aperture 4521 arranged on a bottom end thereof and communicating with the first eyelet 4521, the first eyelet 451 is used to insert the first support 41 for coupling with one of the four pushing posts 35, and the second eyelet 452 is served to insert the second support 42 for connecting with one of the four pushing posts 35, wherein the first support 41 extends and retracts in the first eyelet 451, and the second support 42 extends and retracts in the second eyelet 452, such that gas exhausts out of the first aperture 4511 and the second aperture 4521. The second tube 46 has a third eyelet 462 and a fourth eyelet 463 defined on two ends thereof and communicating with the trench 461, the third eyelet 462 is used to insert the third support 43 for coupling with one of the four pushing posts 35, and the fourth eyelet 462 is applied to insert the fourth support 44 for connecting with one of the four pushing posts 35, wherein the third support 43 extends and retracts in the third eyelet 462, and the fourth support 44 extends and retracts in the fourth eyelet 463, such that the gas exhausts out of the trench 461, and the second tube 46 has the first guide peg 47 and the second guide peg 48; wherein the rotary shaft 37 includes a vertical extension 371 and a horizontal extension 372 being perpendicular to the vertical extension 371 and in connection with the vertical extension 371, the vertical extension 371 is fixed by a second bearing 6 and extends out of the seat 8, the horizontal extension 372 has a first tilted bar 373 obliquely extending from one end thereof, and the first tilted bar 373 has a first opening 374 defined thereon, the first opening 374 has a first rotatable bearing 375 secured therein, the first rotatable bearing 375 is in connection with the first guide peg 47 of the second tube 46 so that a rotary free degree is formed between the first guide peg 47 and the first rotatable bearing 375; the gear set 36 includes three panels 362 connecting with the bottom plate 161 of the holder 16 so as to form a room 361, an upper gear 363 and a bottom gear 365 inserted into and being coaxial with a top portion of the panel 362, a drive gear 364 and a driven gear 366 coupling with the bottom portion of the panel 362 by using a rotary stem 367 and meshing with the upper gear 363 and the lower gear 364, wherein the drive gear 364 has a second tilted bar 368 mounted thereon for corresponding to the first tilted bar 373, the second tilted bar 368 has a second opening 3681 arranged thereon, a second rotatable bearing 369 received in the second opening 3681, such that a distal end of the second guide peg 48 inserts in the second rotatable bearing 369 (so that a rotary free degree is formed between the second guide peg 48 and the second rotatable bearing 369), and the rotary stem 367 of the driven gear 366 is in connection with a top end of the connecting rod 24 of the gas valve 2 so that when the drive gear 364 rotates four circles, the driven gear 366 is driven by the upper gear 363 and the lower gear 365 to rotate one circle. In other words, the gear set 36 is used to control a rotating speed ratio of the rotary shaft 37 or the driven assembly 4 and the gas valve 2, and the rotating speed ratio is 4:1.

The seat 8 (as illustrated in FIG. 2) has a peripheral side coupling with a top rim of the holder 16, a fixed pole 5 axially connecting with the holder 16 and the base 1 and screwed by a nut 7; wherein the vertical extension 371 of the rotary shaft 37 extends out of the seat 8, and the vertical extension 371 and the seat 8 are fixed together by the second bearing 6 (such as a thrust bearing) so that the vertical extension 371 has an axially rotary free degree.

After connecting the base 1, the gas valve 2, the holder 16, the driving device 3, and the seat 4 together, lubricating oil is fed into the holder 16 so that the drive device 3 operates smoothly.

Figure 4:
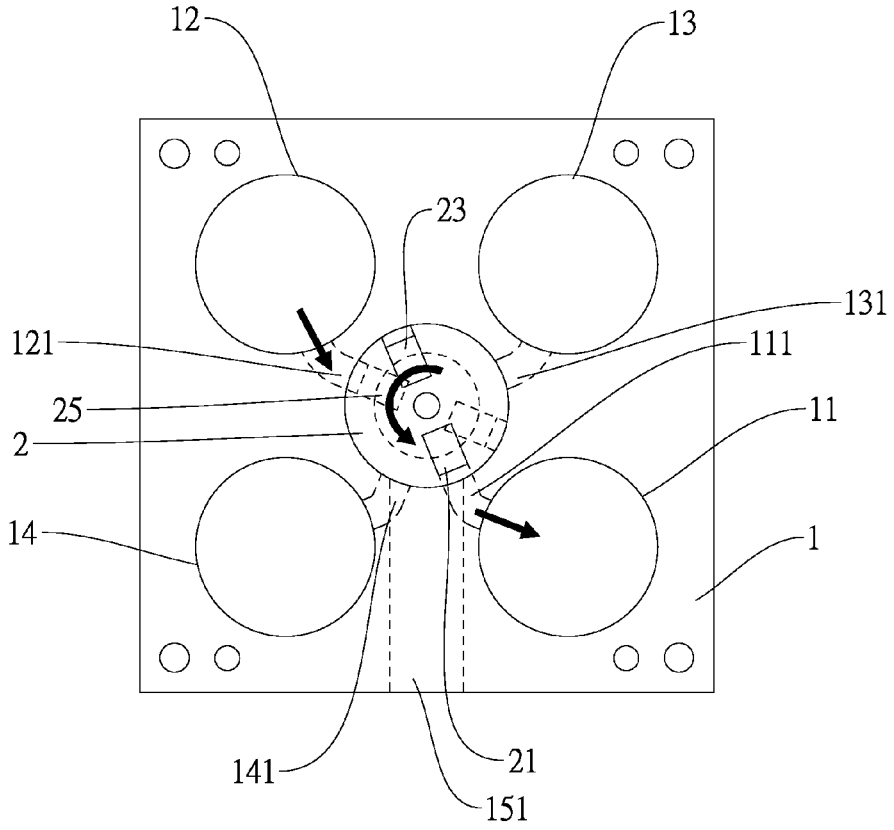
FIG. 4 is a plan view showing a gas valve controlling a gas feeding and a gas exhausting in a first cylinder, a second cylinder, a third cylinder, and a fourth cylinder according to the first embodiment of the present invention.

As shown in FIG. 4, when the four-cylinder four-stroke engine starts operation, the two second inlets 21 and the two thirds outlets 25 of the gas valve 2 correspond to the first flowing hole 111 of the first cylinder 11 and the second flowing hole 121 of the second cylinder 12 so that the gas flows into the first cylinder 11 via the 151 of the base 1, the two second inlets 21 of the gas valve 2, the first flowing hole 111 of the first cylinder 11, and the gas in the second cylinder 12 flows out of the first outlet 152 of the base 1 through the third outlet 25 of the gas valve 2 and the gas flowing hole 121 of the second cylinder 12. Because the third flowing hole 131 of the third cylinder 13 and the fourth flowing hole 141 of the fourth cylinder 14 do not correspond to the second inlet 20 and the second outlet 21 of the gas valve 2, when the gas valve 2 operates, the first cylinder 11 feeds the gas, the second cylinder 12 exhausts the gas, the third cylinder 13 bursts the gas, and the fourth cylinder 14 compresses the gas.

Figure 5A:
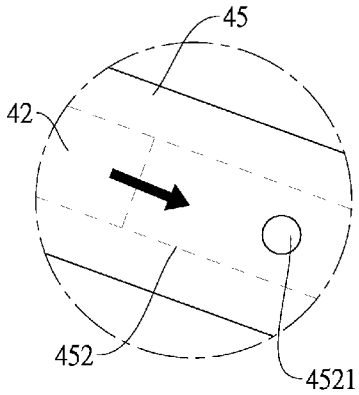
FIG. 5A is a plan view showing the operation of the first cylinder and the second cylinder of the four-cylinder four-stroke engine of FIG. 4 according to the first embodiment of the present invention.
Figure 5A:
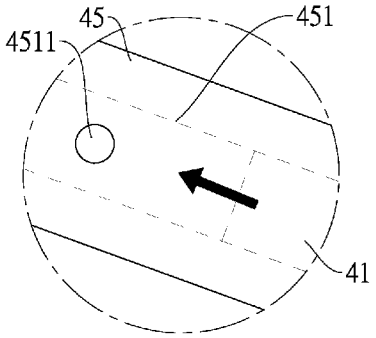
Figure 5A:
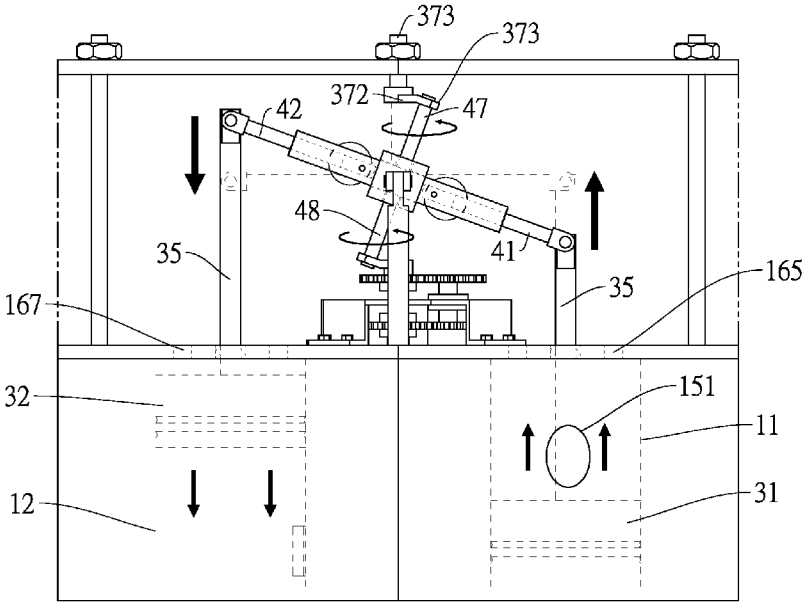

FIG. 5A shows an operation of the first cylinder 11, wherein the first cylinder 11 drives the first piston 31 and the four pushing posts 35 to move upwardly, and then the first piston 31 and the four pushing posts 35 move upward and downward repeatedly so that the gas is fed into the first cylinder 11. When the first piston 31 and the four pushing posts 35 are pushed upwardly, the gas above the first piston 31 of the first cylinder 11 exhausts out of the two second orifices 165 so that the first piston 31 and one of the four pushing posts 35 move upward vertically in the first cylinder 11, and one of the four pushing posts 35 in the first cylinder 11 drives one of the four supports 41 which connects with one of the four pushing posts 35 in the first cylinder 11.

FIG. 5A also shows an operation of the second cylinder 12, wherein the gas in the second cylinder 12 exhausts out of the first outlet 152 of the base 1 through the gas flowing hole 121 of the second cylinder 12 so that the second piston 32 and one of the four pushing posts 35 in the second cylinder 12 push downwardly to exhaust the gas repeatedly. When the second piston 32 and one of the four pushing posts 35 push downwardly, the gas above the second piston 32 of the second cylinder 12 is fed into the two fourth orifices 167 so that the second piston 32 and one of the four pushing posts 35 move downward vertically in the second cylinder 12, and one of the four pushing posts 35 in the second cylinder 12 drives one of the four supports 41 which connects with one of the four pushing posts 35 in the second cylinder 12.

Figure 5B:
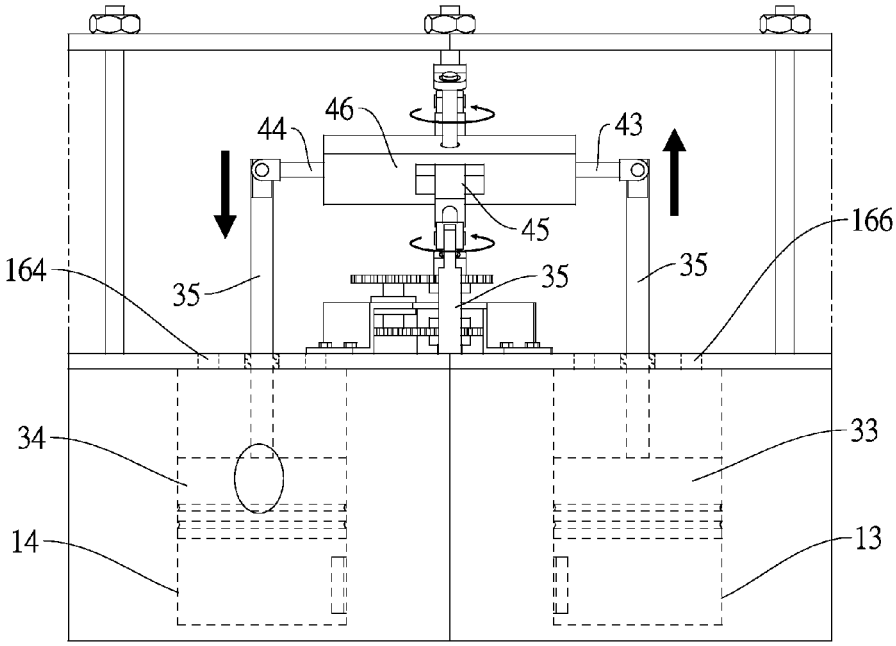
FIG. 5B is a plan view showing the operation of the third cylinder and the fourth cylinder of the four-cylinder four-stroke engine of FIG. 4 according to the first embodiment of the present invention.
Figure 5C:
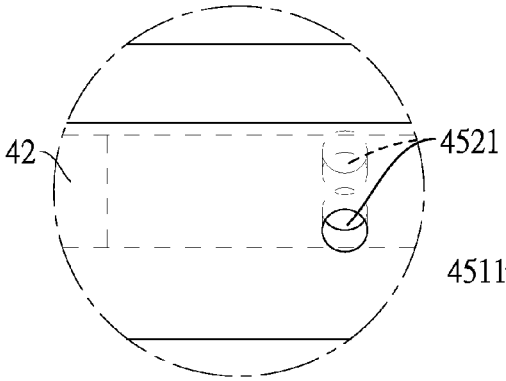
FIG. 5C is a plan view showing the operation of FIG. 5A according to the first embodiment of the present invention.
Figure 5C:
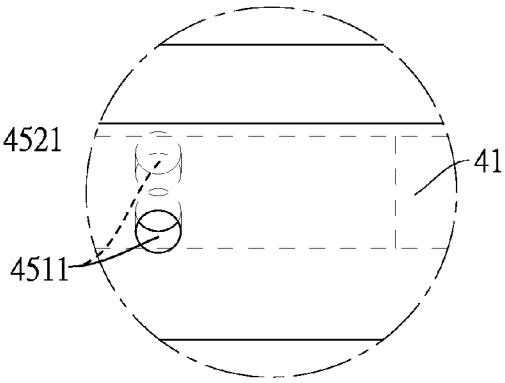
Figure 5C:
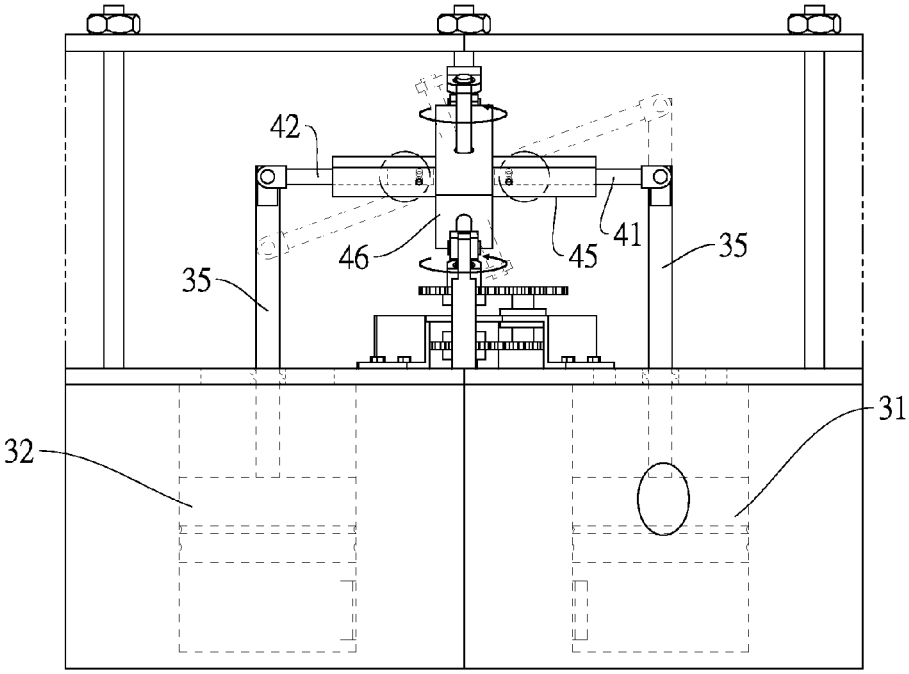
Figure 5D:
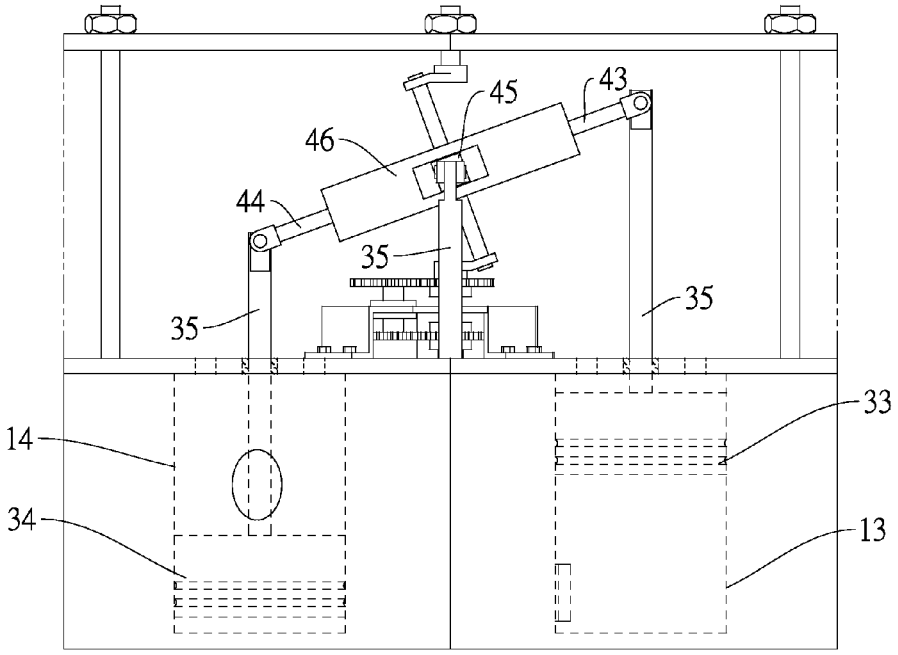
FIG. 5D is a plan view showing the operation of FIG. 5B according to the first embodiment of the present invention.

FIG. 5B shows an operation of the third cylinder 13, wherein the third piston 33 and one of the four pushing posts 35 in the third cylinder 13 push upwardly to burst the gas repeatedly. When the third piston 33 and one of the four pushing posts 35 push upwardly, the gas above the third piston 33 of the third cylinder 13 is exhausted out of the two third orifices 166 so that the third piston 33 and one of the four pushing posts 35 move upward vertically in the third cylinder 13, and one of the four pushing posts 35 in the third cylinder 13 drives one of the four supports 41 which connects with one of the four pushing posts 35 in the third cylinder 13.

FIG. 5B also shows an operation of the fourth cylinder 14, wherein the fourth piston 34 and one of the four pushing posts 35 in the fourth cylinder 14 push downwardly to compress the gas repeatedly. When the fourth piston 34 and one of the four pushing posts 35 push downwardly, gas above the fourth piston 34 of the fourth cylinder 14 is fed into the two first orifices 164 so that the fourth piston 34 and one of the four pushing posts 35 move downward vertically in the fourth cylinder 14, and one of the four pushing posts 35 in the fourth cylinder 14 drives one of the four supports 41 which connects with one of the four pushing posts 35 in the fourth cylinder 14.

Referring to FIGS. 5A to 5D, when the first piston 31, the second piston 32, the third piston 33, the fourth piston 34 of the first cylinder 11, the second cylinder 12, the third cylinder 13, and the fourth cylinder 14 and the four pushing posts 35 move upward and downward repeatedly in the first cylinder 11, the second cylinder 12, the third cylinder 13, and the fourth cylinder 14, the gas above the first piston 31, the second piston 32, the third piston 33, and the fourth piston 34 of the first cylinder 11, the second cylinder 12, the third cylinder 13, and the fourth cylinder 14 are exhausted or fed so that the first piston 31, the second piston 32, the third piston 33, the fourth piston 34 and the four pushing posts 35 move vertically in the first cylinder 11, the second cylinder 12, the third cylinder 13, and the fourth cylinder 14, and then when the first piston 31 and one of the four pushing posts 35 in the first cylinder 11 feed the gas, the second piston 32 and one of the four pushing posts 35 in the second cylinder 12 exhaust the gas, such that two of the four pushing posts 35 in the first cylinder 11 and the second cylinder 12 drive the first support 41 and the second support 42 move inward and outward repeatedly in the first eyelet 451 and the second eyelet 452 of the first tube 45 so that the first tube 46 drives the second tube 46 to rotate frontward and rearward repeatedly, and the second tube 46 moves horizontally and repeatedly in the trench 461. When the third piston 33 and one of the four pushing posts 35 in the third cylinder 13 burst the gas, and the fourth piston 34 and one of the four pushing posts 35 in the fourth cylinder 14 compress the gas, two of the four pushing posts 35 in the third cylinder 13 and the fourth cylinder 14 drive the third support 43 and the fourth support 44 to move repeatedly in the third eyelet 462 and the fourth eyelet 463 of the second tube 46, thus rotating the second tube 46 frontward and rearward repeatedly. As shown in FIG. 2, the first support 41 and the second support 42 can move in the first eyelet 451 and the second eyelet 452, because when the first support 41 and the second support 42 push inwardly or outwardly in the first eyelet 451 and the second eyelet 452, the gases in the first eyelet 451 and the second eyelet 452 exhaust out of or feed into the first aperture 4511 and the second aperture 4521 so that the first support 41 and the second support 42 move in the first eyelet 451 and the second eyelet 452 repeatedly. On the contrast, when the third support 43 and the four support 44 push inwardly or outwardly in the third eyelet 462 and the fourth eyelet 463, the gases in the third eyelet 462 and the fourth eyelet 463 exhaust out of or feed into the trench 461 so that the third support 43 and the fourth support 44 move in the third eyelet 462 and the fourth eyelet 463 repeatedly. When the first cylinder 11, the second cylinder 12, the third cylinder 13, and the fourth cylinder 14 feed, exhaust, burst, and compress the gasses in turn, the first support 41, the second support 42, the third support 43, and the fourth support 44 drive the driven assembly 4 so that the first guide peg 47 of the second tube 46 is limited by the first rotatable bearing 375 of the first tilted bar 373 of the rotary shaft 37, and the first guide peg 47 drives the first tilted bar 373, the horizontal extension 372, and the vertical extension 371 to rotate counterclockwise, thus generating a rotational energy.

During a rotation of the first guide peg 47, the second guide peg 48 rotates relative to the first guide peg 47 counterclockwise so as to further drive the drive gear 364, such that the upper gear 363, the lower gear 365, and the driven gear 366 are driven by the drive gear 364, and then the upper gear 363, the lower gear 365, and the driven gear 366 drive the connecting rod 24 of the gas valve 2 to rotate counterclockwise with a rotary stems 367 which rotates with the driven gear 366.

Figure 6:
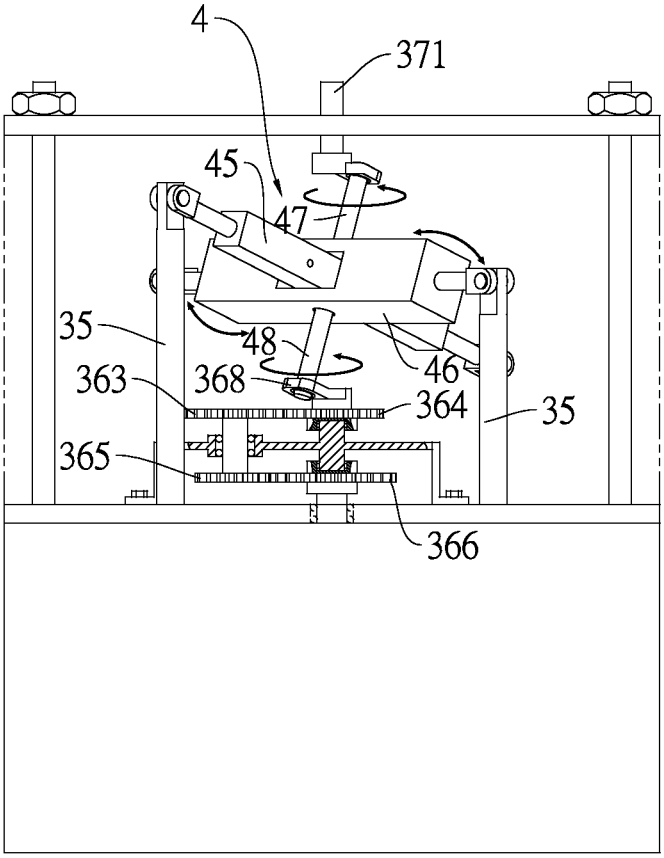
FIG. 6 is a perspective view showing the operation of a driven assembly, a rotary shaft, and a gear set of the four-cylinder four-stroke engine according to the first embodiment of the present invention.

As illustrated in FIG. 6, when the gas valve 2 rotates ¼ circle and drives the first cylinder 11, the second cylinder 12, the third cylinder 13, and the fourth cylinder 14 to feed, exhaust, burst, and compress the gasses, the four pushing posts 35 drive the driven assembly 4 to swing so that the rotary shaft 37 rotates one circle to generate the rotational energy, and the gear set 36 drives the connecting rod 24 of the gas valve 2 so that the gas valve 2 rotates counterclockwise.

It is to be noted that when the four pushing posts 35 push upwardly and downwardly, a lateral force does not produce, such that the first piston 31, the second piston 32, the third piston 33, and the fourth piston 34 do not wear and break the first cylinder 11, the second cylinder 12, the third cylinder 13, and the fourth cylinder 14, thus prolonging a service life of the four-cylinder four-stroke engine. When the driven assembly 4 swings frontward and rearward, the first tube 45 moves horizontally in the trench 461 of the second tube 46 so as to prevent from an interference among the first cylinder 11, the second cylinder 12, the third cylinder 13, and the fourth cylinder 14, thereby operating the first cylinder 11, the second cylinder 12, the third cylinder 13, and the fourth cylinder 14 smoothly.

Figure 7:
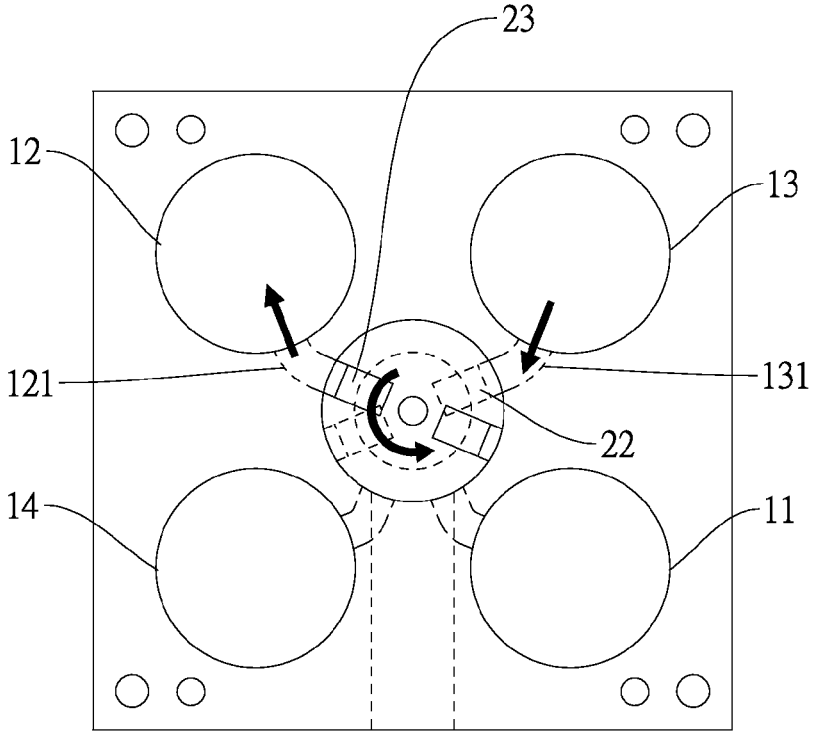
FIG. 7 is a plan view showing the gas valve rotating a second ¼ circle to control the gas feeding and the gas exhausting among the first cylinder, the second cylinder, the third cylinder, and the fourth cylinder according to the first embodiment of the present invention.
Figure 8A:
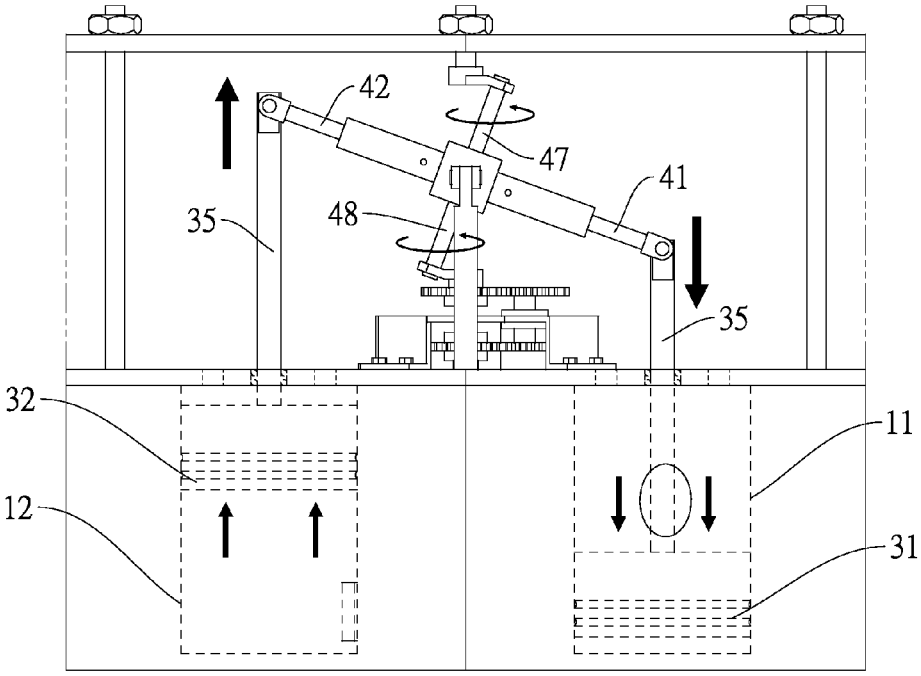
FIG. 8A is a plan view showing the operation of the first cylinder and the second cylinder of the four-cylinder four-stroke engine of FIG. 7 according to the first embodiment of the present invention.
Figure 8B:
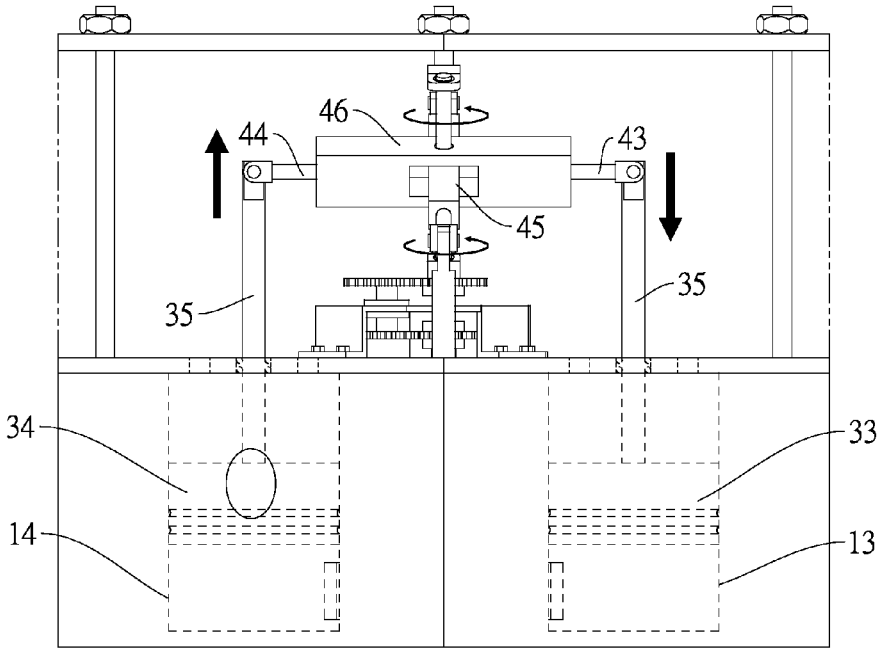
FIG. 8B is a plan view showing the operation of the third cylinder and the fourth cylinder of the four-cylinder four-stroke engine of FIG. 7 according to the first embodiment of the present invention.

With reference to FIGS. 7, 8A and 8B, when the gas valve 2 rotates a first ¼ circle in a first stroke (as shown in FIG. 4), the second outlet 21 of the gas valve 2 aligns with the first flowing hole 111 of the first cylinder 11, the third outlet 25 aligns with the gas flowing hole 121 of the second cylinder 12, and the third flowing hole 131 of the third cylinder 13 and the fourth flowing hole 141 of the fourth cylinder 14 are covered by the gas valve 2, thus closing the third cylinder 13 and the fourth cylinder 14. Thereafter, the first cylinder 11 feeds the gas, the second cylinder 12 exhausts the gas, the third cylinder 13 bursts the gas, and the fourth cylinder 14 compresses the gas. Due to the gas valve 2 keeps rotating ¼ circle counterclockwise so as to have a second stroke, the gas valve 2 rotates as shown from FIG. 4 to FIG. 7. For example, the two second outlets 22 of the gas valve 2 are in alignment with the third flowing hole 131 of the third cylinder 13, the two third inlets 23 align with the gas flowing hole 121 of the second cylinder 12, and the first flowing hole 111 of the first cylinder 11 and the fourth flowing hole 141 of the fourth cylinder 14 are covered by the gas valve 2, thus closing the first cylinder 11 and the fourth cylinder 14. Thereby, when the gas valve 2 keeps rotating a second ¼ circle to have a second stroke (as illustrated from FIG. 4 to the FIG. 7), the first cylinder 11 compresses the gas, the second cylinder 12 feeds the gas, the third cylinder 13 exhausts the gas, and the fourth cylinder 14 bursts the gas.

Referring to FIG. 7, when the gas valve 2 rotates the first ¼ circle counterclockwise to have the first stroke and rotates the second ¼ circle to have the second stroke, the first cylinder 11 operates from a gas feeding process to a gas compressing process, the second cylinder 12 operates from a gas exhausting process to a gas feeding process, the third cylinder 13 operates from a gas bursting process to the gas exhausting process, and the fourth cylinder 14 operates from the gas compressing process to the gas bursting process. The operations of the first cylinder 11, the second cylinder 12, the third cylinder 13, and the fourth cylinder 14 in the second stroke of the gas valve 2 have been described above, further remarks are omitted.

With reference to FIGS. 8A and 8B, when the first cylinder 11 pushes downwardly to compress the gas and the second cylinder 12 pushes upwardly to feed the gas, and the third cylinder 13 pushes downwardly to exhaust the gas and the fourth cylinder 14 pushes upwardly to burst the gas, the four pushing posts 35 in the first cylinder 11, the second cylinder 12, the third cylinder 13, and the fourth cylinder 14 drive the first support 41, the second support 42, the third support 43, and the fourth support 44 to operate, and then the first support 41, the second support 42, the third support 43, and the fourth support 44 drive the driven assembly 4 to swing frontward and rearward. Due to the driving process has been described above, further remarks are omitted.

When the driven assembly 4 swings frontward and rearward, the first guide peg 47 drives the vertical extension 371 to rotate counterclockwise so as to generate the rotational energy (and since the process which the first cylinder 11, the second cylinder 12, the third cylinder 13, and the fourth cylinder 14 drive the rotary shaft 37 has been described above, further remarks are omitted). Furthermore, the second guide peg 48 drives the gear set 36 and the gas valve 2 simultaneously, and the process which the second guide peg 48 of the driven assembly 4 drives the gear set 36 and the gas valve 2 has been mentioned in above description, so further remarks are omitted.

Figure 9:
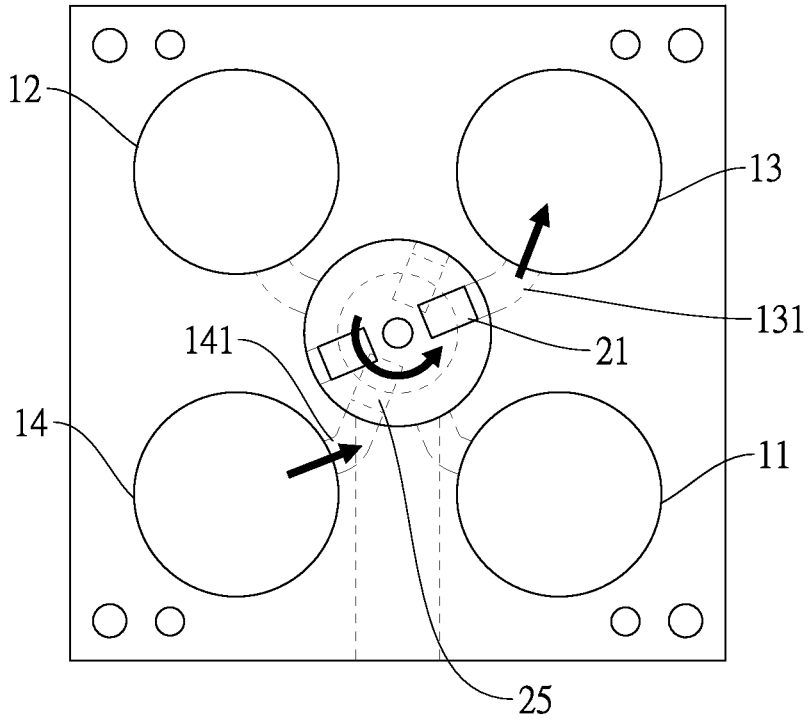
FIG. 9 is a plan view showing the gas valve rotating a third ¼ circle to control the gas feeding and the gas exhausting among the first cylinder, the second cylinder, the third cylinder, and the fourth cylinder according to the first embodiment of the present invention.
Figure 10A:
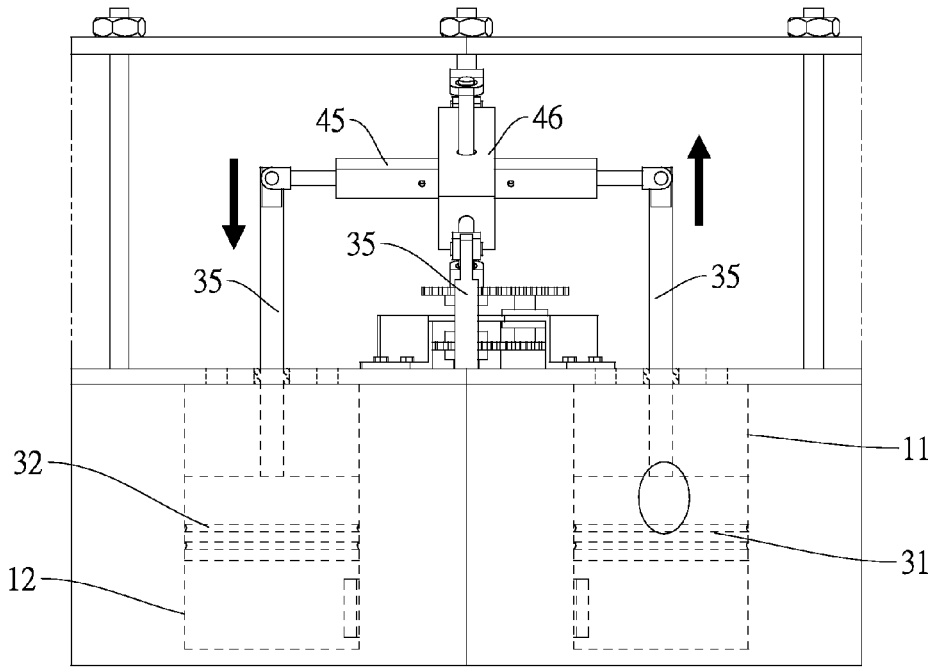
FIG. 10A is a plan view showing the operation of the first cylinder and the second cylinder of the four-cylinder four-stroke engine of FIG. 9 according to the first embodiment of the present invention.
Figure 10B:
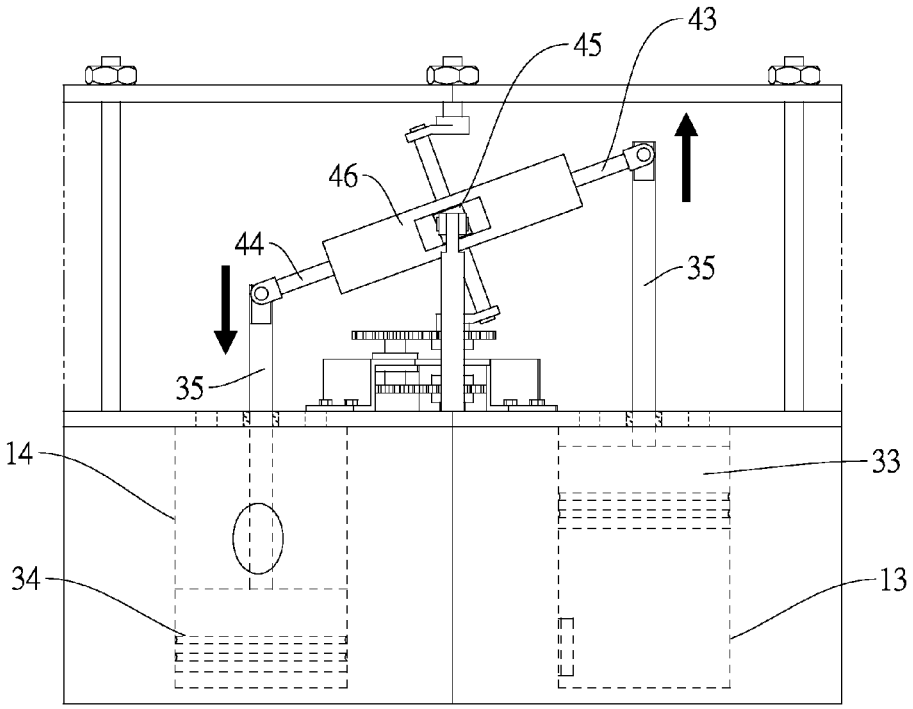
FIG. 10B is a plan view showing the operation of the third cylinder and the fourth cylinder of the four-cylinder four-stroke engine of FIG. 9 according to the first embodiment of the present invention.

As shown in FIGS. 9, 10A, and 10B, when the gas valve 2 rotates the second ¼ circle to have the second stroke (As illustrated in FIG. 7, the two second outlets 22 of the gas valve 2 are in alignment with the third flowing hole 131 of the third cylinder 13, the two third inlets 23 align with the gas flowing hole 121 of the second cylinder 12, and the first flowing hole 111 of the first cylinder 11 and the fourth flowing hole 141 of the fourth cylinder 14 are covered by the gas valve 2, thus closing the first cylinder 11 and the fourth cylinder 14), such that the first cylinder 11 compresses the gas, the second cylinder 12 feeds the gas, the third cylinder exhausts the gas, and the fourth cylinder 14 bursts the gas. When the gas valve 2 rotates a third ¼ circle to have a third stroke, the gas valve 2 rotates as shown from FIG. 7 to FIG. 9, wherein the second outlet 21 of the gas valve 2 aligns with flowing hole 131 of the third cylinder 13, the third outlet 25 aligns with the fourth flowing hole 141 of the fourth cylinder 14, and the first flowing hole 111 of the first cylinder 11 and the gas flowing hole 121 of the second cylinder 12 are covered by the gas valve 2, thus closing the first cylinder 11 and the second cylinder 12. Accordingly, when the gas valve 2 rotates the third ¼ circle to have the third stroke (as illustrated from FIG. 7 to FIG. 9), the first cylinder 11 bursts the gas, the second cylinder 12 compresses the gas, the third cylinder 13 feeds the gas, and the fourth cylinder 14 exhausts the gas.

Referring to FIG. 9, after the gas valve 2 rotates the second ¼ circle counterclockwise to have the second stroke, it keeps rotating the third ¼ circle to have the third stroke, such that the first cylinder 11 bursts the gas after compressing the gas, the second cylinder 12 compresses the gas after feeding the gas, the third cylinder 13 feeds the gas after feeding the gas, and the fourth cylinder 14 exhausts the gas after bursting the gas. Because when the gas valve 2 rotates the third ¼ circle to have the third stroke, the operations of the first cylinder 11, the second cylinder 12, the third cylinder 13, and the fourth cylinder 14 have been described above, further remarks are omitted.

With reference to FIGS. 10A and 10B, when the first cylinder 11 pushes upwardly to burst the gas, the second cylinder 12 pushes downwardly to compress the gas, the third cylinder 13 pushes upwardly to feed the gas, and the fourth cylinder 14 pushes downwardly to exhaust the gas, the four pushing posts 35 in the first cylinder 11, the second cylinder 12, the third cylinder 13, and the fourth cylinder 14 drive the first support 41, the second support 41, the third support 43, and the fourth support 44 to actuate the driven assembly 4 to swing frontward and rearward. Because such a driving process is mentioned in above description, further remarks are omitted.

When the driven assembly 4 swings frontward and rearward, the first guide peg 47 drives the vertical extension 371 to rotate counterclockwise so as to generate the rotational energy (and since the process which the first cylinder 11, the second cylinder 12, the third cylinder 13, and the fourth cylinder 14 drive the rotary shaft 37 has been described above, further remarks are omitted). Furthermore, the second guide peg 48 drives the gear set 36 and the gas valve 2 simultaneously, and the process which the second guide peg 48 of the driven assembly 4 drives the gear set 36 and the gas valve 2 has been mentioned in above description, so further remarks are omitted.

Figure 11:
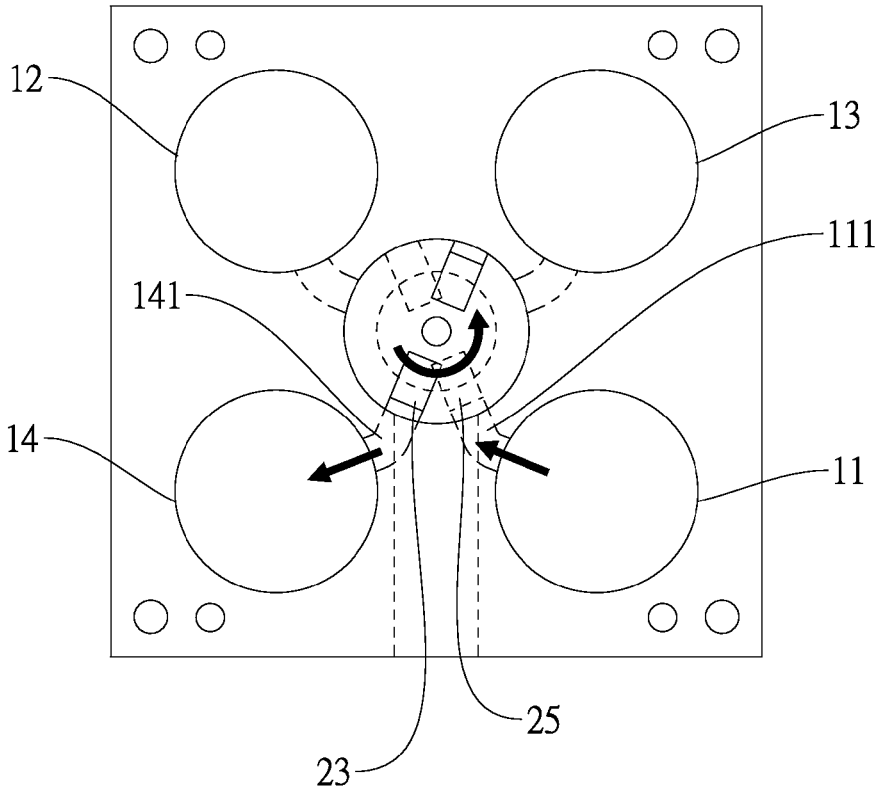
FIG. 11 is a plan view showing the gas valve rotating a fourth ¼ circle to control the gas feeding and the gas exhausting among the first cylinder, the second cylinder, the third cylinder, and the fourth cylinder according to the first embodiment of the present invention.
Figure 11A:
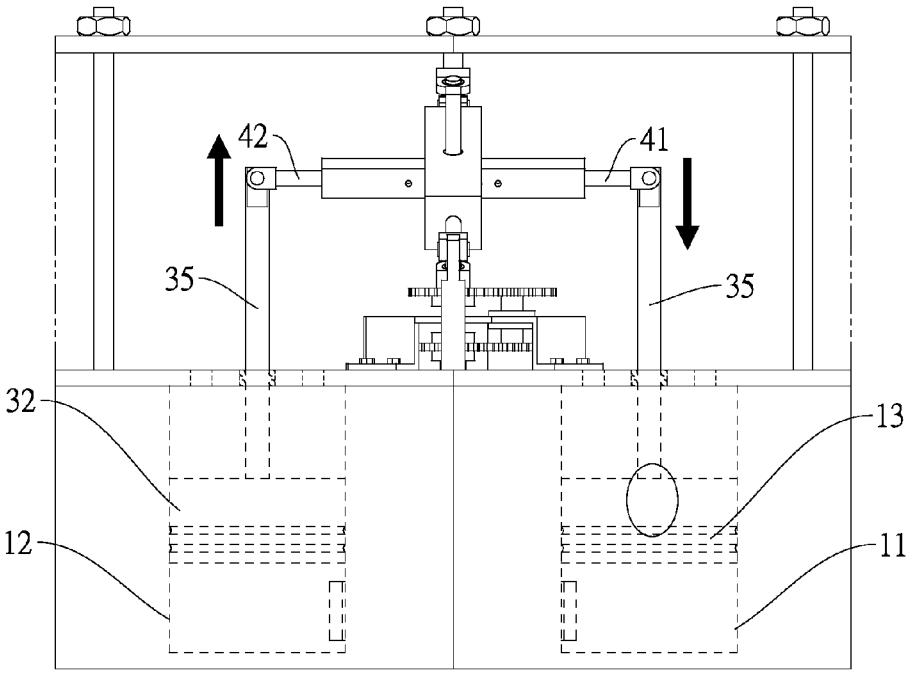
FIG. 11A is a plan view showing the operation of the first cylinder and the second cylinder of the four-cylinder four-stroke engine of FIG. 11 according to the first embodiment of the present invention.
Figure 11B:
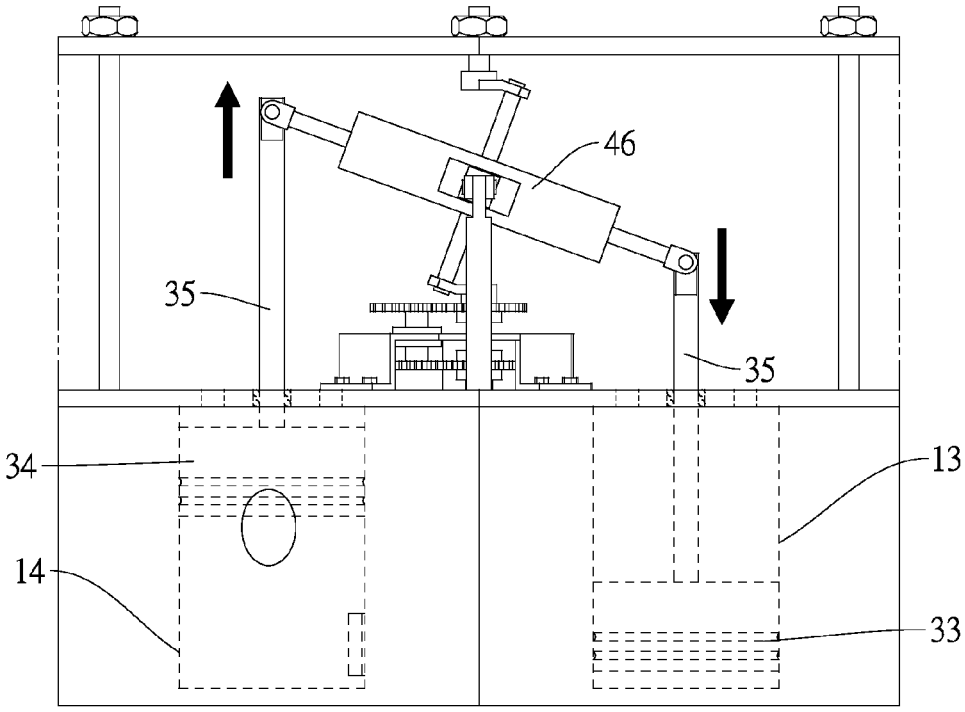
FIG. 11B is a plan view showing the operation of the third cylinder and the fourth cylinder of the four-cylinder four-stroke engine of FIG. 11 according to the first embodiment of the present invention.

As shown in FIGS. 11, 11A and 11B, when the gas valve 2 rotates the third ¼ circle to have the third stroke (As illustrated in FIG. 9, the second outlet 21 of the gas valve 2 aligns with the third flowing hole 131 of the third cylinder 13, the third outlet 25 aligns with the fourth flowing hole 141 of the fourth cylinder 14, and the first flowing hole 111 of the first cylinder 11 and the gas flowing hole 121 of the second cylinder 12 are covered by the gas valve 2, thus closing the first cylinder 11 and the second cylinder 12), such that the first cylinder 11 bursts the gas, the second cylinder 12 compresses the gas, the third cylinder 13 feeds the gas, and the fourth cylinder 14 exhausts the gas. When the gas valve 2 further rotates a fourth ¼ circle to have a fourth stroke, the gas valve 2 operates from FIG. 9 to FIG. 11, and the third outlet 25 is in alignment with the first flowing hole 111 of the first cylinder 11, the two third inlets 23 align with the fourth flowing hole 141 of the fourth cylinder 14, and the gas flowing hole 121 of the second cylinder 12 and the third flowing hole 131 of the third cylinder 13 are covered by the gas valve 2, thus closing the second cylinder 12 and the third cylinder 13. Accordingly, when the gas valve 2 rotates the fourth ¼ circle counterclockwise to have the fourth stroke (as illustrated from FIG. 9 to FIG. 11), the first cylinder 11 exhausts the gas, the second cylinder 12 bursts the gas, the third cylinder 13 compresses the gas, and the fourth cylinder 14 feeds the gas.

As illustrated in FIG. 11, after the gas valve 2 rotates the third ¼ circle counterclockwise to have the third stroke, it rotates the fourth ¼ circle to have the fourth stroke so that the first cylinder 11 exhausts the gas, the second cylinder 12 bursts the gas, the third cylinder 13 compresses the gas, and the fourth cylinder 14 feeds the gas. Because the gas valve 2 rotates the fourth ¼ circle to have the fourth stroke, the operations of the first cylinder 11, the second cylinder 12, the third cylinder 13, and the fourth cylinder 14 are mentioned in above descriptions, further remarks are omitted.

Referring further to FIGS. 11A and 11B, when the first cylinder 11 pushes downwardly to exhaust the gas, the second cylinder 12 pushes upwardly to burst the gas, the third cylinder 13 pushes downwardly to compress the gas, and the fourth cylinder 14 pushes upwardly to feed the gas, the four pushing posts 35 in the first cylinder 11, the second cylinder 12, the third cylinder 12, and the fourth cylinder 14 drive the first support 41, the second support 42, the third support 43, and the fourth support 44 to operate, and then the driven assembly 4 is driven by the first support 41, the second support 42, the third support 43, and the fourth support 44 to swing frontward and rearward. Since the driving process of the driven assembly 4 is described above, further remarks are omitted.

When the driven assembly 4 swings frontward and rearward, the first guide peg 47 drives the vertical extension 371 to rotate counterclockwise so as to generate the rotational energy (and since the process which the first cylinder 11, the second cylinder 12, the third cylinder 13, and the fourth cylinder 14 drive the rotary shaft 37 has been described above, further remarks are omitted). Furthermore, the second guide peg 48 drives the gear set 36 and the gas valve 2 simultaneously, and the process which the second guide peg 48 of the driven assembly 4 drives the gear set 36 and the gas valve 2 has been mentioned in above description, so further remarks are omitted.

After the gas valve 2 rotates the first ¼ circle, the first cylinder 11, the second cylinder 12, the third cylinder 13, the fourth cylinder 14 finish operation in the first stroke, and then the gas valve 2 keeps rotating counterclockwise so that it rotates the second ¼ circle to have the second stroke, hence the first cylinder 11, the second cylinder 12, the third cylinder 13, and the fourth cylinder 14 finish operation in the second stroke as shown in FIGS. 4, 7, 9, and 11. Thereafter, the gas valve 2 rotates the third ¼ circle to have the third stroke so that the first cylinder 11, the second cylinder 12, the third cylinder 13, and the fourth cylinder 14 finish operation in the third stroke as shown in FIGS. 4, 7, 9, and 11, and then the gas valve 2 keeps rotating the fourth ¼ circle counterclockwise to have the fourth stroke, such that the first cylinder 11, the second cylinder 12, the third cylinder 13, and the fourth cylinder 14 finish operation in the fourth stroke as shown in FIGS. 4, 7, 9, and 11, thus finishing the stroke operation of the four-cylinder four-stroke engine. When the first cylinder 11, the second cylinder 12, the third cylinder 13, and the fourth cylinder 14 finish stroke operations in the first stroke, the second stroke, the third stroke, and the fourth stroke, the gas valve 2 rotates one circle, and the driven assembly 4 is driven by the first cylinder 11, the second cylinder 12, the third cylinder 13, and the fourth cylinder 14 to rotate four circles, such that the rotary shaft 37 rotates four circles.

Thereby, the first cylinder 11, the second cylinder 12, the third cylinder 13, and the fourth cylinder 14 feed, compress, burst, and feed the gases in the first, the second, the third, the fourth strokes without resulting in interference, thus producing the rotational energy.

Figure 12:
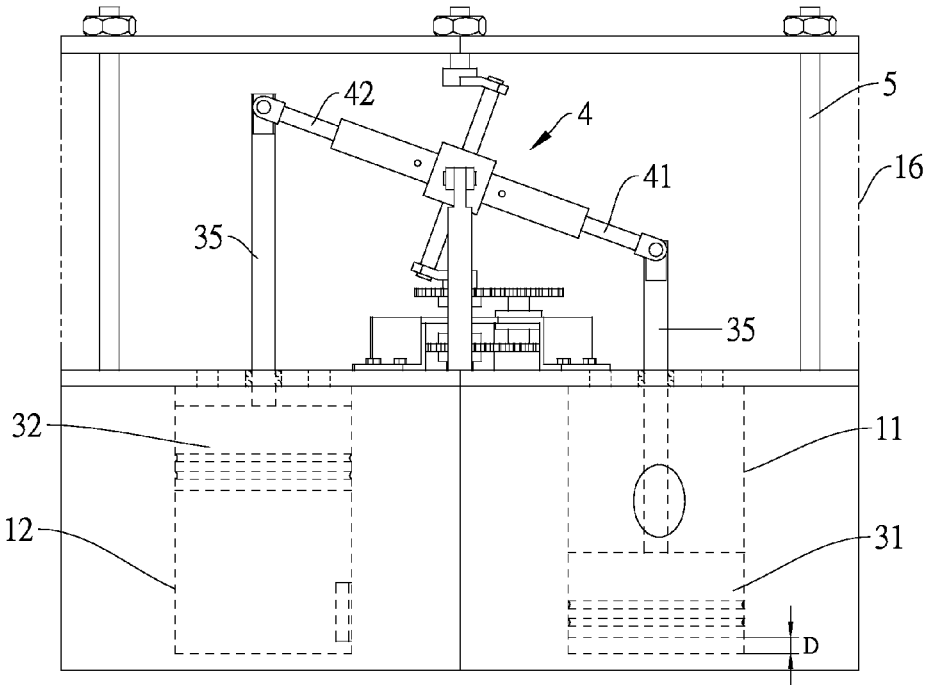
FIG. 12 is a plan view showing a compression ratio in the first cylinder, the second cylinder, the third cylinder, and the fourth cylinder being controlled according to the first embodiment of the present invention.

As shown in FIG. 12, to control a compression ratio of the first cylinder 11, the second cylinder 12, the third cylinder 13, and the fourth cylinder 14 in a second embodiment, when installing a fixed pole 5 and a holder 16, a user chooses a suitable vertical length so as to determine four limit heights D in the first cylinder 11, the second cylinder 12, the third cylinder 13, and the fourth cylinder 14, wherein the four limit heights D are used to connect the seat 8 and the first piston 31, the second piston 32, the third piston 33, and the fourth piston 34 via the rotary shaft 37, the driven assembly 4, and four pushing posts 35 (wherein each limit height D changes based on two vertical lengths of the fixed pole 5 and the holder 16), such that the first cylinder 11, the second cylinder 12, the third cylinder 13, and the fourth cylinder 14 have various compression ratios so that the four-cylinder four-stroke engine is applicable for gasoline fuel.

Figure 13:
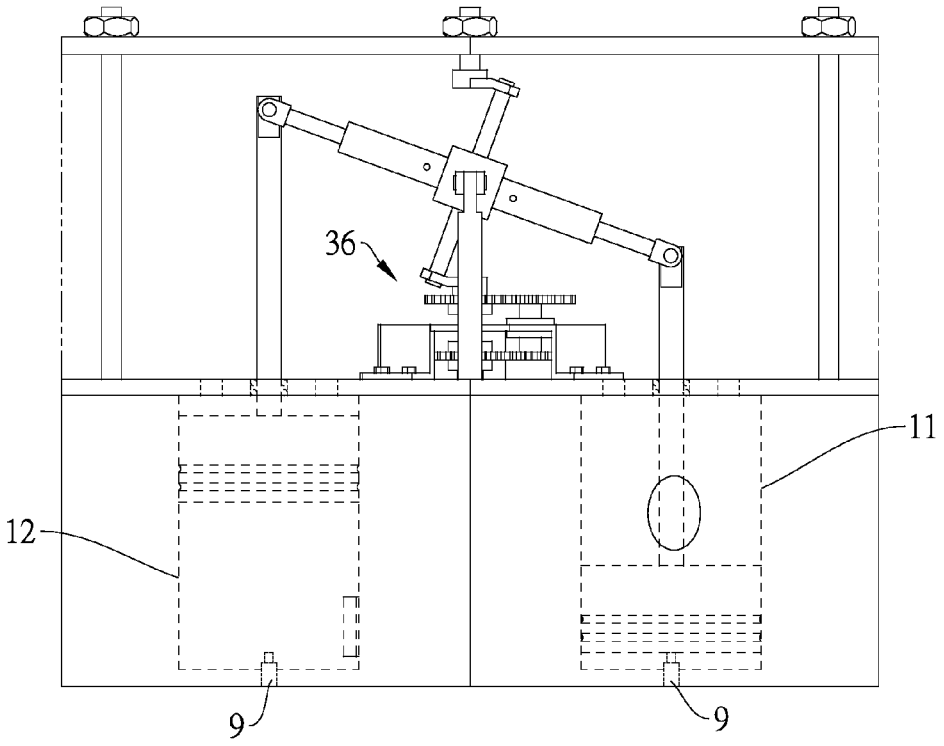
FIG. 13 is a plan view showing four spark plugs being fixed in the first cylinder, the second cylinder, the third cylinder, and the fourth cylinder according to a second embodiment of the present invention.

Referring further to FIG. 13, when the first cylinder 11, the second cylinder 12, the third cylinder 13, and the fourth cylinder 14 are applicable for gasoline fuel, four spark plugs 9 are mounted in the first cylinder 11, the second cylinder 12, the third cylinder 13, and the fourth cylinder 14 so that when the first cylinder 11, the second cylinder 12, the third cylinder 13, and the fourth cylinder 14 compress the gases, the four spark plugs 9 ignite mixed oil gas so as to burst the gases after compressing the gases.

In addition, any two adjacent of the first, the second, the third, and the fourth cylinders 11, 12, 13, 14 are symmetrically arranged around the gas valve 2; a rotating circle number of the drive gear 364 is at least two times more than the driven gear 366, i.e., the gear set 36 controls a rotating speed ratio of the rotary shaft 37 or the driven assembly 4 and the gas valve 2, and the rotating speed ratio is □ four times.

While we have shown and described various embodiments in accordance with the present invention, it is clear to those skilled in the art that further embodiments may be made without departing from the scope of the present invention.

What is claimed is:

1. A four-cylinder four-stroke engine without a crankshaft and valves comprising:

a base, a gas valve, a holder, a driving device, and a driven assembly, and a seat, wherein when a four-cylinder four-stroke engine operates, a plurality of cylinders push plural pistons in the plurality of cylinders of the driving device so as to drive plural pushing posts connecting with the plural pistons to move upward and downward repeatedly, such that the driven assembly coupling with the plural pushing posts is pushed to drive a rotary shaft to rotate, thus generating a rotational energy, and the driven assembly simultaneously pushes a gear set of the driving device so that the gear set drives the gas valve on the base to rotate 360 degrees to feed and exhaust gases in the base, characterized in that:

the base includes a gas groove defined thereon, a first cylinder, a second cylinder, a third cylinder, and a fourth cylinder, wherein any two adjacent of the first, the second, the third, and the fourth cylinders are symmetrically arranged around the gas groove, and the first cylinder has a first flowing hole for communicating with the gas groove, the second cylinder has a second flowing hole for communicating with the gas groove, the third cylinder has a third flowing hole for communicating with the gas groove, the fourth cylinder has a fourth flowing hole for communicating with the gas groove; the gas groove has a first inlet formed on a side wall thereof and communicating with an exterior of the base, and a first outlet defined on a bottom surface thereof and communicating with the exterior of the base; wherein a bottom plate of the holder is screwed on a top surface of the base by ways of plural screw elements, such that the gas groove, the first cylinder, the second cylinder, the third cylinder, the fourth cylinder of the base are covered by the bottom platen, and the gas groove includes a washer fixed on a top rim thereof so that the holder closes the gas groove;

the gas valve is disposed in the gas groove and includes two second inlets which communicate with each other and two third inlets which are in communication with each other, wherein one of the two second inlets is defined on a top surface of the gas valve, and the other of the two second inlets is formed on an external wall of the gas valve, one of the two third inlets is defined on the top surface of the gas valve, and the other of the two third inlets is formed on the external wall of the gas valve; the gas valve also includes two second outlets which communicate with each other and two third inlets which are in communication with each other, wherein one of the two second outlets is defined on a bottom surface of the gas valve, and the other of the two second outlets is formed on the external wall of the gas valve, one of the two third outlets is defined on the bottom surface of the gas valve, and the other of the two third outlets is formed on the external wall of the gas valve; wherein an angle between the two second inlets and the two third outlets is 135 degrees, and between the two third inlets and the two second outlets is 135 degrees, and when the gas valve operates, the two second inlets, the two third inlets, the two second outlets, and the two third outlets are in communication with the first flowing hole, the second flowing hole, the third flowing hole, and the fourth flowing hole; and the gas valve further includes four first bearings, mounted on the top surface of the gas valve, extending out of the bottom plate, and driving a connecting rod of the gas valve;

the driving device includes four pushing posts for connecting with a first piston, a second piston, a third piston, and a fourth piston, the driven assembly connects with four top ends of the four pushing rods, and the driving device also includes the rotary shaft connecting with a first guide peg of the driven assembly, the gear set coupled with a second guide peg of the driving device, four ends of the four pushing posts join with a first support, a second support, a third support, and a fourth support via four pivots; the driven assembly includes a first tube, a second tube, the first support, the second support, the third support, and the fourth support, wherein the first tube is mounted and moves horizontally in a trench of the second tube, the first tube has a first eyelet and a second eyelet defined on two ends thereof, and the first eyelet has a first aperture formed on a bottom end thereof, the second eyelet has a second aperture arranged on the bottom end thereof and communicating with the first eyelet, the first eyelet is used to insert the first support for coupling with one of the four pushing posts, and the second eyelet is used to insert the second support for connecting with one of the four pushing posts, wherein the first support extends and retracts in the first eyelet, and the second support extends and retracts in the second eyelet, such that gas exhausts out of the first aperture and the second aperture; the second tube has a third eyelet and a fourth eyelet defined on two ends thereof and communicating with the trench, the third eyelet is used to insert the third support for coupling with one of the four pushing posts, and the fourth eyelet is applied to insert the fourth support for connecting with one of the four pushing posts, wherein the third support extends and retracts in the third eyelet, and the fourth support extends and retracts in the fourth eyelet, such that the gas exhausts out of the trench, and the second tube has the first guide peg and the second guide peg; wherein the rotary shaft includes a vertical extension and a horizontal extension being perpendicular to the vertical extension and in connection with the vertical extension, the vertical extension is fixed by a second bearing and extends out of the seat, the horizontal extension has a first tilted bar obliquely extending from one end thereof, and the first tilted bar has a first opening defined thereon, the first opening has a first rotatable bearing secured therein, the first rotatable bearing is in connection with the first guide peg of the second tube so that a rotary free degree is formed between the first guide peg and the first rotatable bearing; the gear set includes three panels connecting with the bottom plate of the holder so as to form a room, an upper gear and a bottom gear inserted into and being coaxial with a top portion of at least one of the panels, a drive gear and a driven gear coupling with the bottom portion of at least one of the panels by using a rotary stem and meshing with the upper gear and the lower gear, wherein the drive gear has a second tilted bar mounted thereon for corresponding to the first tilted bar, the second tilted bar has a second opening arranged thereon, a second rotatable bearing received in the second opening, such that a distal end of the second guide peg inserts in the second rotatable bearing so that a rotary free degree is formed between the second guide peg and the second rotatable bearing, and the rotary stem of the driven gear is in connection with a top end of the connecting rod of the gas valve so that when the drive gear rotates four circles, the driven gear is driven by the upper gear and the lower gear to rotate one circle, so the gear set is used to control a rotating speed ratio of the rotary shaft or the driven assembly and the gas valve, and the rotating speed ratio is 4:1;

the seat has a peripheral side coupling with the top rim of the holder, a fixed pole axially connecting with the holder and the base and screwed by a nut; wherein the vertical extension of the rotary shaft extends out of the seat, and the vertical extension and the seat are fixed together by the second bearing so that the vertical extension has an axially rotary free degree.

* * * * *